US012180863B2

(12) United States Patent
Raimondi et al.

(10) Patent No.: US 12,180,863 B2
(45) Date of Patent: Dec. 31, 2024

(54) SWITCHABLE CASTELLATION ASSEMBLY AND METHOD OF OPERATING A SWITCHABLE CASTELLATION DEVICE

(71) Applicant: Eaton Intelligent Power Limited, Dublin (IE)

(72) Inventors: Emanuele Raimondi, Turin (IT); Nicola Andrisani, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/555,020

(22) PCT Filed: Apr. 14, 2022

(86) PCT No.: PCT/EP2022/025147

§ 371 (c)(1),
(2) Date: Oct. 12, 2023

(87) PCT Pub. No.: WO2022/218573

PCT Pub. Date: Oct. 20, 2022

(65) Prior Publication Data

US 2024/0200475 A1 Jun. 20, 2024

Related U.S. Application Data

(60) Provisional application No. 63/175,604, filed on Apr. 16, 2021.

(51) Int. Cl.
*F01L 1/24* (2006.01)
*F01L 1/18* (2006.01)
(Continued)

(52) U.S. Cl.
CPC ..... *F01L 1/2416* (2013.01); *F01L 1/181* (2013.01); *F01L 1/46* (2013.01);
(Continued)

(58) Field of Classification Search
CPC . F01L 1/2416; F01L 1/181; F01L 1/46; F01L 2001/467; F01L 2013/001; F01N 13/0005; F01N 13/06
(Continued)

(56) References Cited

U.S. PATENT DOCUMENTS 4,200,081 A 4/1980 Meyer et al.
4,227,494 A 10/1980 Uitvlugt
(Continued)

FOREIGN PATENT DOCUMENTS

WO 2019/036272 A1 2/2019
WO 2019/133658 A1 7/2019
WO 2020/151924 A1 7/2020

OTHER PUBLICATIONS

International Search Report issued in corresponding application No. PCT/EP2022/025147 dated Aug. 11, 2022, 3 pages.
(Continued)

*Primary Examiner* — Kenneth J Hansen
*Assistant Examiner* — Kelsey L Stanek
(74) *Attorney, Agent, or Firm* — Meunier Carlin & Curfman LLC

(57) ABSTRACT

A switchable castellation assembly can include a lost motion shaft, the lost motion shaft being configured to transfer a lift profile to a valve end. A switchable castellation device can comprise a rotatable first spline bushing and a spline body, wherein the first spline bushing can be changed between a locked position and an unlocked position, and a lost motion can be obtained by sliding the lost motion shaft.

18 Claims, 5 Drawing Sheets

(51) Int. Cl.
*F01L 1/46* (2006.01)
*F01L 13/00* (2006.01)
*F01L 13/06* (2006.01)

(52) U.S. Cl.
CPC ..... *F01L 2001/467* (2013.01); *F01L 13/0005* (2013.01); *F01L 2013/001* (2013.01); *F01L 13/06* (2013.01)

(58) Field of Classification Search
USPC ..... 123/90.65
See application file for complete search history.

(56) References Cited

U.S. PATENT DOCUMENTS

| | | | | |
|---|---|---|---|---|
| 6,273,039 | B1 | 8/2001 | Church | |
| 6,354,265 | B1 | 3/2002 | Hampton et al. | |
| 2018/0187579 | A1 | 7/2018 | Cecur | |
| 2020/0325803 | A1* | 10/2020 | Patil | F01L 1/181 |

OTHER PUBLICATIONS

Written Opinion issued in corresponding application No. PCT/EP2022/025147 dated Aug. 11, 2022, 9 pages.

* cited by examiner

SWITCHABLE CASTELLATION ASSEMBLY AND METHOD OF OPERATING A SWITCHABLE CASTELLATION DEVICE

CROSS-REFERENCE TO RELATED APPLICATIONS

This is a National Stage application of PCT international application PCT/EP2022/025147, filed on Apr. 14, 2022, which claims priority to U.S. Provisional Patent Application No. 63/175,604, filed Apr. 16, 2021, which are incorporated herein by reference in their entireties.

FIELD

This application relates to castellation devices usable in a variety of valvetrain actuations. The castellation device may be configured with a switchable stroke.

BACKGROUND

A castellation device may be configured with a switchable stroke to switch between valve lift profiles such as engine braking, cylinder deactivation, and variations such as early or late valve opening or close (EIVC, LIVC, EEVO, LEVO, etc.), or combinations that permit negative valve overlap (NVO) or internal exhaust gas recirculation (iEGR). A castellation device may implement such valve lift profiles by introducing varying amounts of lost motion in which some or all of a lift profile is absorbed rather than transferred to a valve head.

Lost motion may also include some amount of lash supplied by the castellation device to compensate for variations in the lash of the entire valve train caused by, for example, thermal expansion, thermal contraction, or wear.

SUMMARY

Rocker arm systems, valvetrain systems, rocker arms, and valve actuating assemblies herein comprise alternative castellation mechanisms such as those described in, for example, WO 2019/133658, WO 2019/036272, US2020/0325803, US2018/0187579, U.S. Pat. Nos. 4,227,494, 6,354,265, 6,273,039, & U.S. Pat. No. 4,200,081, which are herein incorporated by reference in their entirety. The castellation device disclosed herein may be used in rocker arm systems, valvetrain systems, rocker arms, and valve actuating assemblies such as those disclosed in these same exemplary publications. The castellation device herein, also called a switchable castellation device, can be used in other systems where switchable mechanisms are employed. So, while illustrated in a rocker arm, the switchable castellation device can be installed in other valvetrain components such as carriers and towers, among others.

The methods and devices disclosed herein improve the art by way of a switchable castellation assembly comprising a lost motion shaft, the lost motion shaft being configured to transfer a lift profile to a valve end. And, a switchable castellation device. The switchable castellation device comprises a rotatable first spline bushing and a spline body. The first spline bushing can be configured to switch between a locked position and an unlocked position. A lost motion can be obtained by sliding the lost motion shaft when the first spline bushing is in the unlocked position.

A second spline bushing can be configured to switch between a second locked position and a second unlocked position.

A guide can align the spline body with the first spline bushing. A guide can also align the spline body with the first spline bushing and the second spline bushing.

A lash regulation screw can be included for setting a lash for the lost motion shaft.

A lost motion spring can be configured to bias the lost motion shaft to a fully extended position. The lost motion spring can be configured to collapse during the lost motion.

A first actuator can be configured for rotating the first spline bushing between the locked position and the unlocked position. A second actuator can be configured for rotating the second spline bushing between the second locked position and the second unlocked position.

As an alternative, a switchable castellation assembly can comprise a lost motion shaft comprising an axis with a top end and a bottom end. A lash regulation screw can be arranged at the top end of the lost motion shaft. A lost motion spring can be arranged along the axial length of the lost motion shaft. A first spline bushing can be arranged along the axial length of the lost motion shaft. A guide can be arranged along the axial length of the lost motion shaft. And, a spline body can be arranged along the axial length of the lost motion shaft. The first spline bushing can be positioned to selectively receive or block the spline body. The guide can be configured to orient the spline body with respect to the first spline bushing. When the first spline bushing is in a first position to receive the spline body, motion exerted on the switchable castellation device can be absorbed by the switchable castellation device. And, when the first spline bushing is in a second position to block the spline body, motion exerted on the switchable castellation device is not absorbed by the switchable castellation device.

The first spline bushing can comprise a first bushing bore forming an outer circumference of the first spline bushing and an inner circumference of the first spline bushing. A first actuator interface can be arranged on, at least some portion of, the outer circumference of the first spline bushing. And, a first spline interface can be arranged on, at least some portion of, the inner circumference of the first spline bushing. The first spline interface can further comprise a first spline index.

The guide can comprise a guide bore forming an outer circumference of the guide and an inner circumference of the guide. A guide notch can be arranged on, at least some portion of, the outer circumference of the guide. And, a guide interface can be arranged on, at least some portion of, the inner circumference of the guide. The guide interface can further comprise a guide index.

The spline body can comprise a spline body bore forming an outer circumference of the spline body and an inner circumference of the spline body. A spline body interface can be arranged on, at least some portion of, the outer circumference of the spline body. The spline body interface can further comprise a spline body index.

The first spline bushing can comprises a first bushing bore forming an outer circumference of the first spline bushing and an inner circumference of the first spline bushing. A first actuator interface can be arranged on, at least some portion of, the outer circumference of the first spline bushing. And, a first spline interface can be arranged on, at least some portion of, the inner circumference of the first spline bushing. The first spline interface can further comprise a first spline index. The guide can comprise a guide bore forming an outer circumference of the guide and an inner circumference of the guide. A guide notch can be arranged on, at least some portion of, the outer circumference of the guide. And, a guide interface can be arranged on, at least some portion of, the inner circumference of the guide. The guide interface can further comprise a guide index. The spline body can comprise a spline body bore forming an outer circumference of the spline body and an inner circumference of the spline body. And, a spline body interface arranged on, at least some portion of, the outer circumference of the spline body. The spline body interface can further comprise a spline body index. The first spline interface can be formed by a plurality of first spline grooves arranged along the axial length of the first spline bushing. The guide interface can be formed by a plurality of guide grooves arranged along the axial length of the guide. And, the spline body interface can be formed by a plurality of spline body grooves arranged along the axial length of the spline body.

The guide grooves can be configured to orient the spline body grooves. The first spline grooves can be configured to receive the spline body grooves in the first position or to block the spline body grooves in the second position.

A method of operating a switchable castellation device can comprise rotating a first spline bushing into an unlocked position, sliding a spline body into the first spline bushing such that the first spline bushing intertwines with the spline body, and sliding the spline body away from the first spline bushing such that the first spline bushing is no longer intertwined with the spline body.

The method of operating a switchable castellation device can comprise rotating the first spline bushing from an unlocked position into a locked position and sliding the spline body into the first spline bushing such that the spline body abuts the first spline bushing but does not intertwine.

The method of operating a switchable castellation device can comprise rotating a second spline bushing into an unlocked position, and sliding a spline body into the first spline bushing and the second spline bushing such that the spline body slidably interacts with at least a portion of the first spline bushing and at least a portion of the second spline bushing.

The method of operating a switchable castellation assembly can comprise rotating a second spline bushing into a locked position, and sliding the spline body into the second spline bushing such that the spline body abuts the second spline bushing but does not slide within any portion of the second spline bushing.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 2:
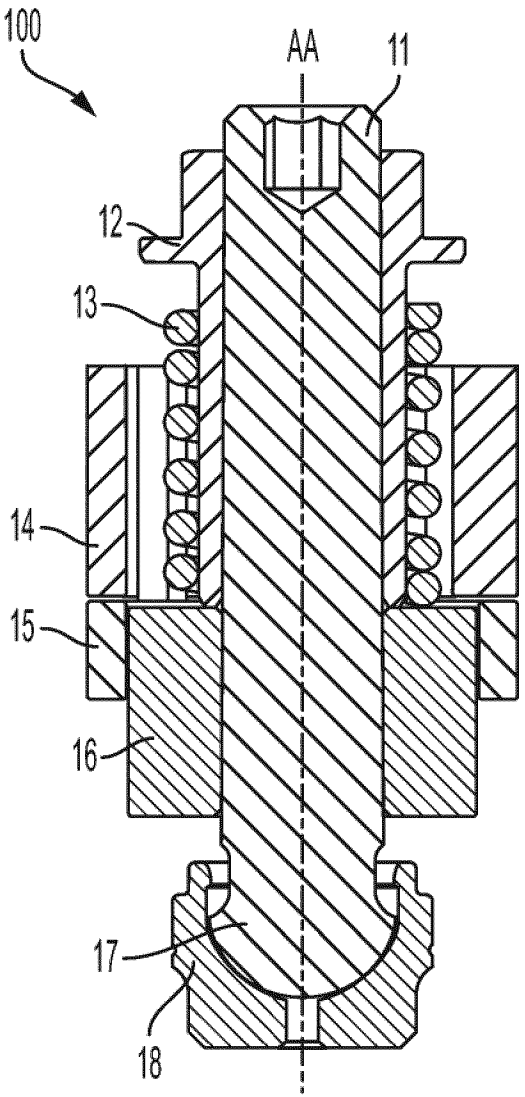
FIG. 1 and FIG. 2 are a perspective view and a cross-section view of a castellation device.
Figure 1:
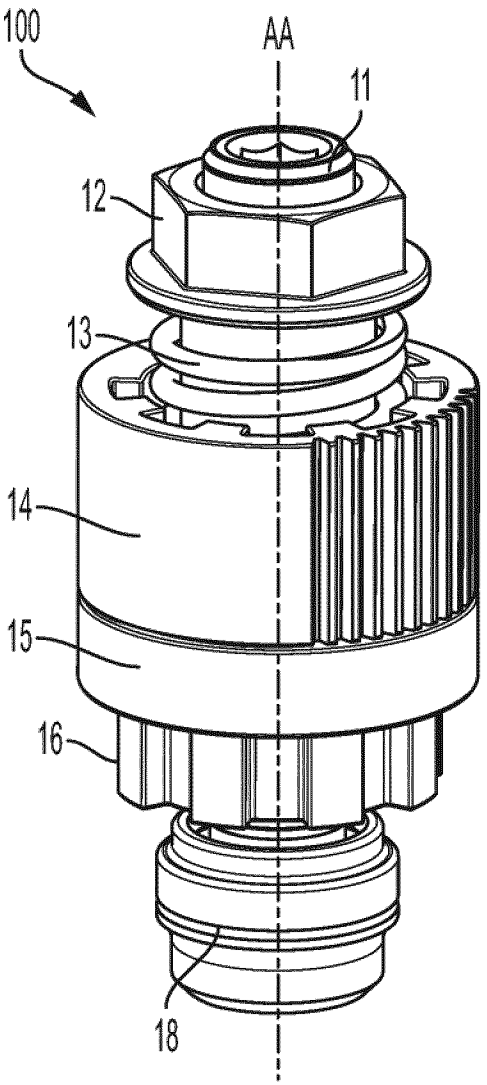

FIG. 1 and FIG. 2 illustrate a perspective view and a cut-away view, respectively, of a switchable castellation device 100. Castellation device 100 lies generally along an axis AA and comprises a lost motion shaft 11, a lash regulation screw 12, a lost motion spring 13, a first spline bushing 14, a guide 15, and a spline body 16. Optionally, lost motion shaft 11 may comprise an end flare 17 on which an optional contact device 18 is mounted, for example, a press-foot, elephant foot, spigot, or similar device, may be mounted on one end of lost motion shaft 11 which may then contact a valve or other device (not pictured). Lash regulation screw 12 and spline body 16 may be attached to lost motion shaft 11 via press, crush fit, threading, or other fasteners.

Lost motion shaft 11 is configured to transfer motion to a valve and is configured to slide in a lost motion mode. First spline bushing 14 is arranged to slide along at least a portion of the axial length of lost motion shaft 11 along axis AA, and will be discussed further below. Lash regulation screw 12 and spline body 16 may be attached to lost motion shaft 11 via threading or other fasteners. Lash regulation screw 12 allows the amount of mechanical lash to be adjusted. Lost motion spring 13 is arranged along the axial length of lost motion shaft 11, or otherwise sleeved on lost motion shaft 11, and may absorb the motion of a valve lift event without causing a valve to open until a travel limit—formed, for example, on castellation device 100 itself or within the structure housing castellation device 100—is reached. Contact device 18 may be configured to press on a valve stem, valve bridge, a rocker arm, or other valve train component.

Figure 3:
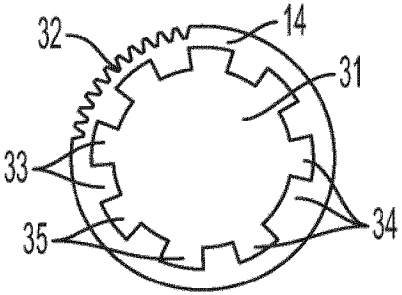
FIG. 3 is a cross-section of a first spline bushing.

FIG. 3 illustrates a top-down view of first spline bushing 14. First spline bushing 14 comprises a ring wider than spline body 16 with a first bushing bore 31 to accommodate spline body 16. First spline bushing 14 is slidable along an axial length of lost motion shaft 11. First spline bushing 14 further comprises a first actuator interface 32 arranged on, at least a portion of, the outer circumference of bushing 14, and first spline interface 33 arranged on, at least a portion of, the inner circumference of bushing 14. First spline interface 33 is able to alternately allow spline body 16 to slide into at least a portion of first spline bushing 14 in one position, and to block spline body 16 from sliding into at least a portion of first spline bushing 14 in another position.

First spline interface 33 comprises mechanisms to allow first spline bushing 14 to receive or block spline body 16 and further comprises a spline index 34 to receive spline body index 53 of spline body 16, which will be discussed further below. First spline interface 33, including optional spline index 34, is formed by a plurality of first spline grooves 35 running the axial length of first spline bushing 14 and parallel to lost motion shaft 11. From a top-down view, grooves 35 appear as teeth and gaps which complement spline body 16 to allow first spline bushing 14 to receive at least some portion of spline body 16 or prevent first spline bushing 14 from receiving at least some portion of spline body 16. While first spline bushing 14 is generally characterized in FIG. 1, FIG. 2, and FIG. 3 as a cylindrical ring, first spline bushing 14 may adopt other shapes configured to slide along lost motion shaft 11.

Figure 4:
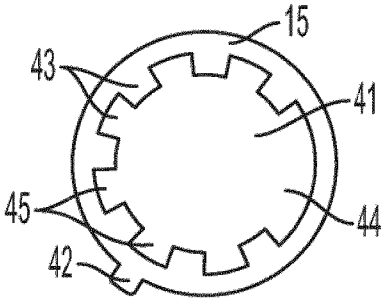
FIG. 4 is a cross-section of a guide.

FIG. 4 illustrates a top-down view of guide 15. Guide 15 comprises an angularly fixed ring wider than spline body 16 with a guide bore 41 to accommodate spline body 16. Guide 15 provides alignment for spline body 16 relative to first spline bushing 14, thereby preventing angular drift of spline body 16. Guide 15 further comprises a guide notch 42 along, at least a portion of, the outer circumference of guide 15, and guide interface 43 arranged on, at least a portion of, the inner circumference of guide 15.

While guide notch 42 is shown as a rectangular protrusion from guide 15, guide notch 42 may comprise other shapes, or even an indentation or indentations rather than a protrusion, along at least some portion of the outer surface of guide 15. Guide notch 42 may mate with a corresponding slot, groove, divot, tab, protrusion, or other feature on a rocker arm or other device such as a carrier or tower in which castellation device 100 is mounted to prevent rotational movement of guide 15.

Guide interface 43 comprises mechanisms for guide 15 to receive spline body 16 as well as a guide index 44 for orienting spline body 16 relative to first spline bushing 14, as further described below. Guide interface 43, including guide index 44, is formed by a plurality of guide grooves 45 running the axial length of guide 15 and parallel to lost motion shaft 11. From a top-down view, grooves 45 appear as teeth and gaps which align with spline body 16 and allow spline body 16 to slide through or pass through at least a portion of guide 15. While guide 15 is generally characterized in FIG. 1, FIG. 2, and FIG. 4 as a cylindrical ring, guide 15 may adopt other shapes.

Figure 5:
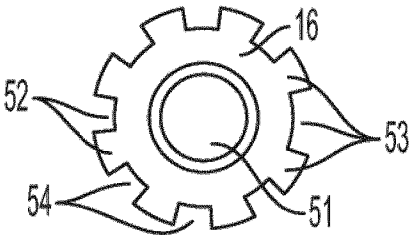
FIG. 5 is a cross-section of a spline body.

FIG. 5 illustrates a top-down view of spline body 16. Spline body 16 comprises a ring, narrower than spline bushing 14 or guide 15, and comprises spline body bore 51 to accommodate lost motion shaft 11. Spline body 16 may be fixed to lost motion shaft 11 via threading or other fasteners. Spline body 16 further comprises a spline body interface 52 along at least a portion of the outer circumference of the ring. In one position, spline body interface 52 allows spline body 16 to slidably interact with at least a portion of first spline bushing 14 and, in another position, spline body interface 52 allows spline body 16 to be blocked from sliding into spline bushing 14.

Spline body interface 52 comprises mechanisms for sliding through or being blocked by spline bushing 14, and further comprises a spline body index 53 for orienting spline body 16 with guide index 44 of guide 15. Spline body interface 52, including spline body index 53, is formed by a plurality of spline body grooves 54 that run along the axial length of spline body 16 parallel to lost motion shaft 11. From a top-down view, grooves 54 appear as teeth and gaps which complement first spline interface 33 and guide interface 43. Spline body index 53 may be a gap or tooth—or arrangement of teeth and gaps—which may slidably interact with first spline index 34 and guide index 44. Similarly, guide index 44 is a complementary formation which may slidably interact with spline body index 53. Likewise, first spline index 34 is a complementary tooth or gap, or set of teeth and gaps, which may slidably interact with spline body index 53.

While first spline bushing 14, guide 15, and spline body 16 are generally characterized in FIGS. 1-5 as cylindrical rings, first spline bushing 14, guide 15, and spline body 16 may adopt other shapes.

Spline body 16 remains within at least a portion of guide 15 throughout. This allows guide 15 to maintain the angular orientation of spline body 16. Keeping spline body 16 sleeved within at least a portion of guide 15, may be used alone or in conjunction with indices 34, 44, 53 to maintain the angular orientation of spline body 16.

While first spline interface 33, guide interface 43, and spline body interface 52 are shown to comprise interlocking teeth with complementary spacing, other interlocking mechanisms may be implemented.

The dimensions of spline body 16 and first spline bushing 14 permitting, grooves 35, 45, and 54 allow for the entirety of spline body 16 to slide into first spline bushing 14, thereby increasing the magnitude of motions that may be absorbed by castellation device 100. Grooves 35, 45, and 54 also result in improved structural durability, thereby allowing first spline bushing 14 and spline body 16 to be constructed with greater axial length, in turn allowing castellation device 100 to absorb a greater amount of lost motion, than prior castellation devices.

Figure 6:
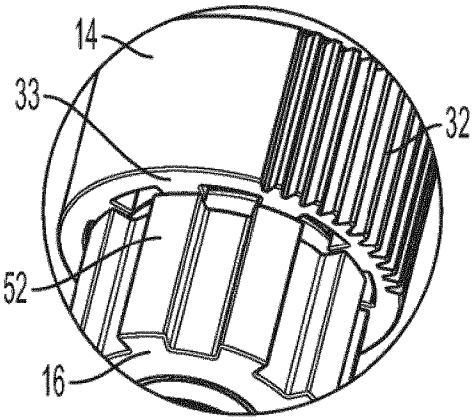
FIGS. 6-8 are perspective views of relative positioning between a first spline bushing and a spline body.
Figure 7:
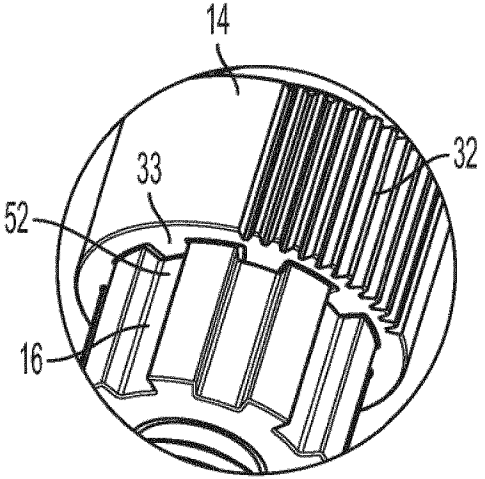
Figure 8:
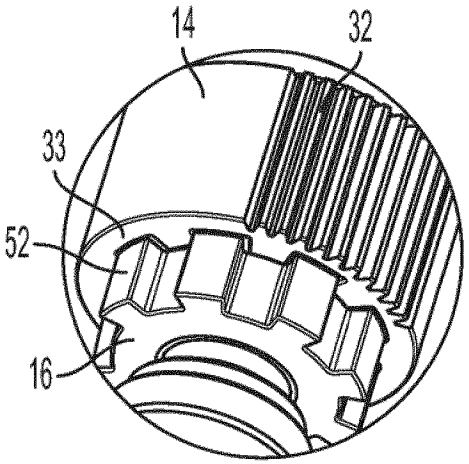

FIG. 6, FIG. 7, and FIG. 8 illustrate perspective views of first spline bushing 14 interacting with spline body 16. Guide 15 is hidden to better show first spline bushing 14 and spline body 16. In FIG. 6, an actuator (not shown) has driven first actuator interface 32, rotating first spline bushing 14 into a locked position. In a locked position, first spline bushing 14 is oriented relative to spline body 16 such that first spline interface 33 aligns with spline body interface 52 so first spline interface 33 and spline body interface 52 cannot slide past each other. Therefore, in a locked position, first spline bushing 14 cannot slide into spline body 16. This results in a short lost motion mode.

In FIG. 7, an actuator (not shown) has driven first actuator interface 32, rotating first spline bushing 14 into an unlocked position. In an unlocked position, first spline bushing 14 is oriented relative to spline body 16 such that first spline interface 33 aligns with spline body interface 52 so first spline interface 33 and spline body interface 52 may slide past each other. Therefore, in an unlocked position, first spline bushing 14 may slide into spline body 16. This results in a long lost motion mode and the amount of lost motion absorbed is increased relative to the castellation device 100 in short lost motion mode.

In FIG. 8, spline bushing 14 has been rotated via first actuator interface 23 into an unlocked position such that first spline interface 33 is aligned with spline body interface 52, and first spline bushing 14 has slid into spline body 16. In this unlocked position, force may be applied to castellation device 100, such that spline body 16 and first spline bore 31 of first spline bushing 14 are slid together. Lost motion spring 13 absorbs at least a portion of the incoming motion.

Figure 9:
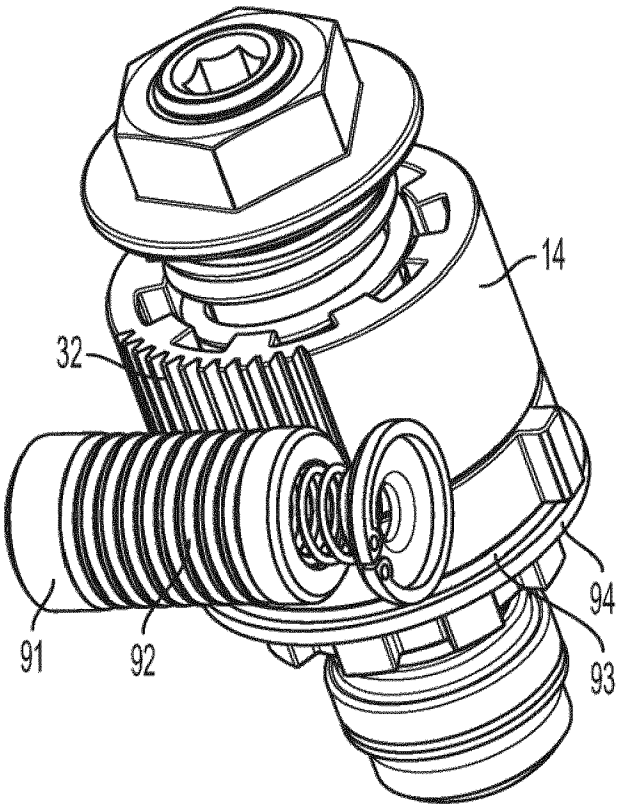
FIG. 9 is a perspective view of a castellation device with an actuator.

FIG. 9 illustrates a perspective view of castellation device 100 with an optional actuator. Actuator 91 may be controlled hydraulically, pneumatically, or electromagnetically. In turn, actuator 91 drives first spline bushing 14 in a clock-wise or counter-clockwise direction with a rack and pinion, though other actuation arrangements may also be used. Actuator 91 comprises an interface 92 which mates with first actuator interface 32 of first spline bushing 14. Through interface 92 and first actuator interface 32, actuator 91 may rotate first spline bushing 14 to switch first spline bushing 14 between locked or unlocked positions. Note that optional washer 93 and optional washer 94 are illustrated and assist in mounting castellation device 100 to a rocker arm or other device. Alternative actuators compatible herewith are described in, for example, WO2021213703, PCT/EP2021/025421, WO2021164950, which are hereby incorporated by reference in their entirety.

Figure 10:
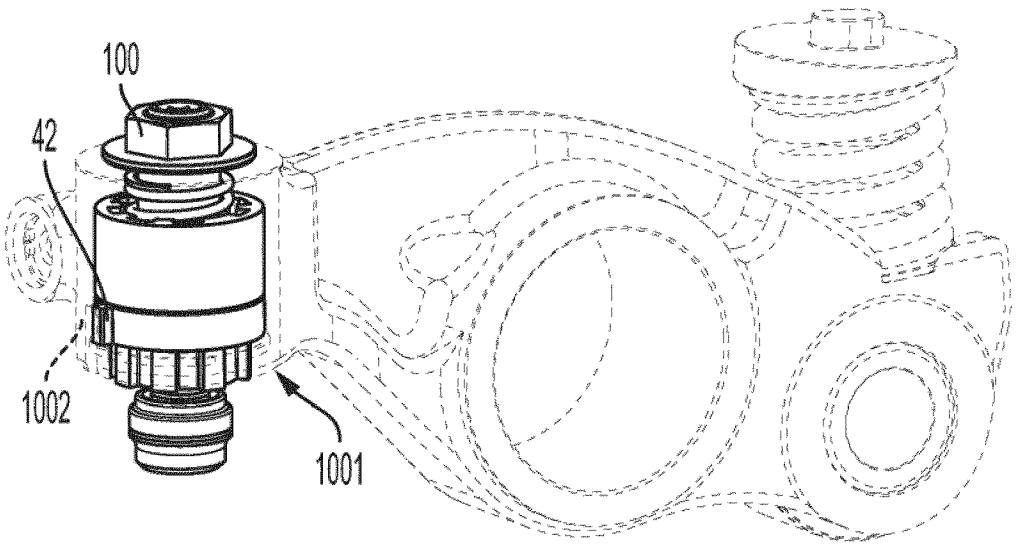
FIG. 10 is a perspective view of a castellation device mounted in a rocker arm, shown in transparency.

FIG. 10 illustrates a perspective view of castellation device 100 mounted to a rocker arm shown in transparency. While this disclosure contemplates the use of castellation device 100 in conjunction with a rocker arm, castellation device 100 or castellation device 200, discussed below, may be used in conjunction with rocker arm systems, valvetrain systems, and valve actuating assemblies such as those disclosed in the publications reference above, as well as in other systems where switchable mechanisms are employed.

In FIG. 10, castellation device 100 is seated in castellation device bore 1001. Bore 1001 may comprise travel limits formed as steps or rims within the inner circumference of bore 1001. The castellation device 100 may absorb valve lift motions, preventing valve actuation force from being transferred to valves until the travel limit is reached.

Bore 1001 further comprises bore guide 1002 to receive guide notch 42 and prevent angular movement of guide 15. While bore guide 1002 is a hollow which receives the protrusion of guide notch 42, bore guide 1002 may adopt other shapes and may itself be a protrusion to fit with its counterpart, guide notch 42, which may also comprise a hollow rather than a protrusion.

Figure 12:
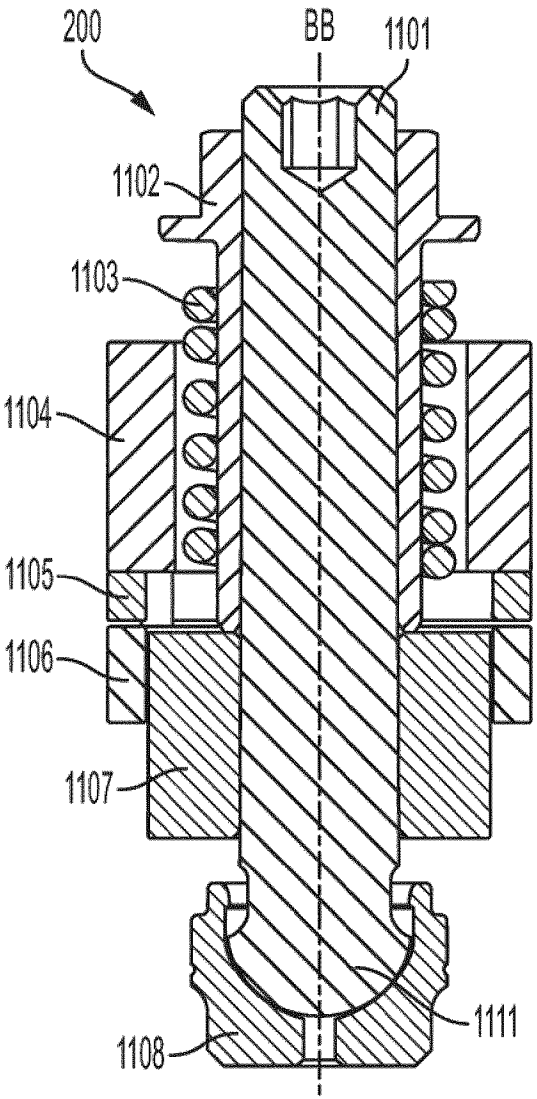
FIG. 11 and FIG. 12 are a perspective view and a cross-section view of a three-stage castellation device.
Figure 11:
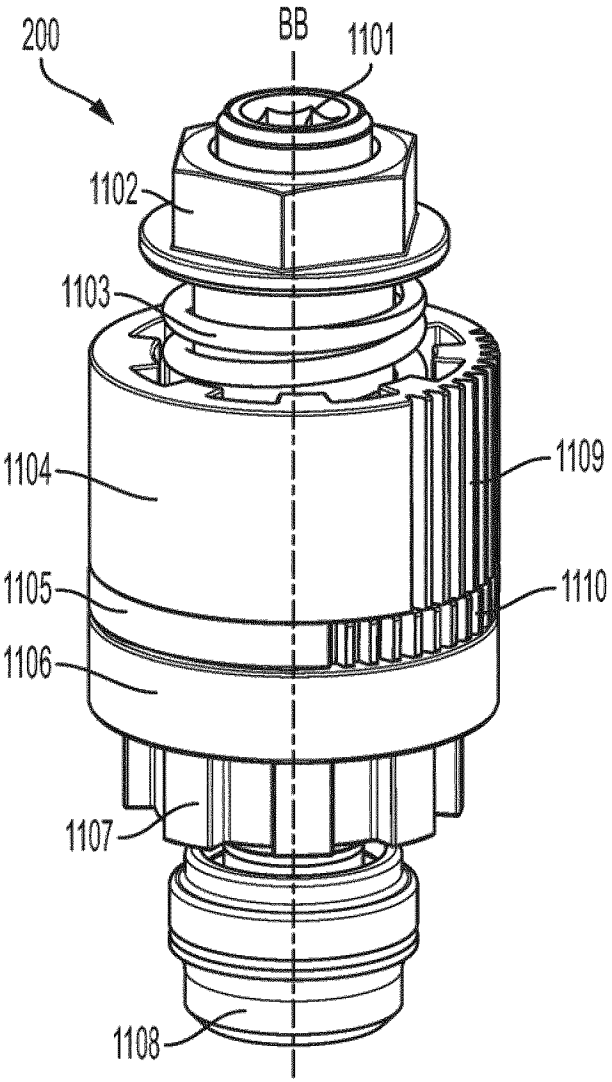

FIG. 11 and FIG. 12 show perspective and cut-away views of an alternative embodiment, a three-stage castellation device 200. Three-stage castellation device 200 lies generally along an axis BB and comprises a lost motion shaft 1101, a lash regulation screw 1102, a lost motion spring 1103, a first spline bushing 1104, a second spline bushing 1105, a guide 1106, and a second spline body 1107, with lost motion shaft 1101 ending in optional end flare 1111 on which optional contact device 1108 is mounted.

Many of the components of castellation device 200 are generally equivalent to the components of castellation device 100. Most notably, first spline bushing 1104 is equivalent to first spline bushing 14. Second spline bushing 1105 is equivalent to first spline bushing 14, though second spline bushing 1105, as illustrated, has a reduced axial length relative to first spline bushing 14 and first spline bushing 1104. However, depending on manufacturing and operating requirements, second spline bushing 1105 may be made to be longer or equal to first spline bushing 14 or first spline bushing 1104 along the axial length. Guide 1106 is equivalent to guide 15 and second spline body 1107 is equivalent to spline body 16.

First spline bushing 1104 and second spline bushing 1105 allow castellation device 200 to implement at least three lost motion modes which are discussed below.

Figure 13A:
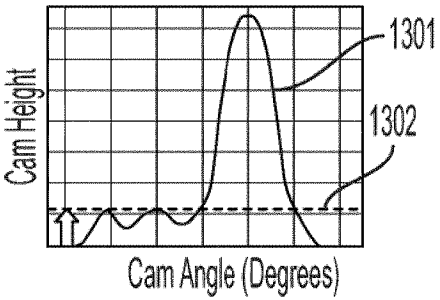
FIG. 13A and FIG. 13B are a chart and a view of a castellation device in standard lift, short lost motion mode.
Figure 13B:
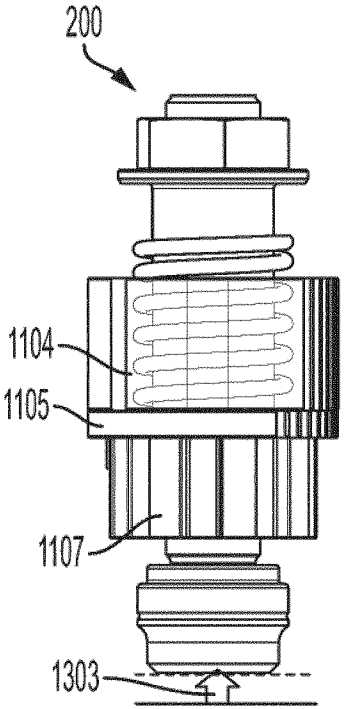

FIG. 13A is a graph and FIG. 13B is an illustration, both showing castellation device 200 in standard lift, short lost motion mode with guide 1106 hidden. In standard lift, short lost motion mode, second spline bushing 1105 is rotated to an unlocked position and first spline bushing 1104 is rotated into a locked position, such that second spline body 1107 is able to slide within at least some portion of second spline bushing 1105. In standard lift mode, using the pictured cam profile 1301, all lift transmitted to castellation device 200 below the magnitude indicated by line 1302 is absorbed—corresponding to the length indicated by arrow 1303—and not transmitted to a valve. Only lift of a magnitude above the indicated line 1302 is transmitted.

Figure 14A:
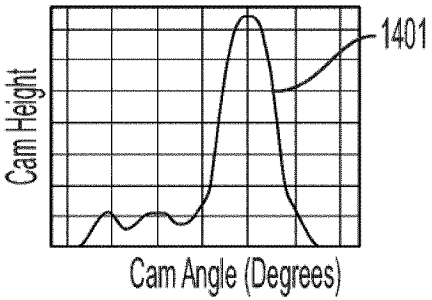
FIG. 14A and FIG. 14B are a chart and a view of a castellation device in engine brake mode.
Figure 14B:
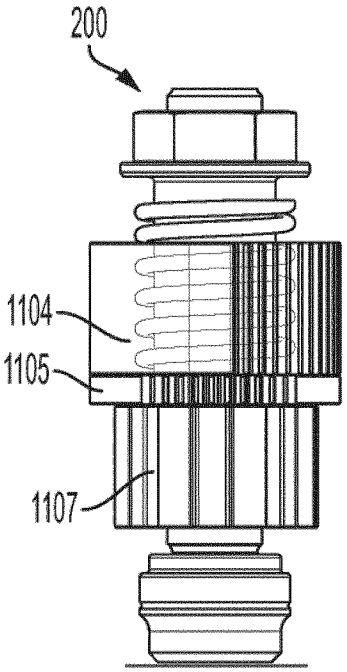

FIG. 14A is a graph and FIG. 14B is an illustration, both showing castellation device 200 in engine brake mode with guide 1106 hidden. In engine brake mode, at least second spline bushing 1105 is rotated to a locked position and second spline body 1107 is unable to slide into either first spline bushing 1104 or second spline bushing 1105. In engine brake mode, using the pictured cam profile 1401, no motion is absorbed by castellation device 200 and the full cam profile is transmitted to a valve.

Figure 15A:
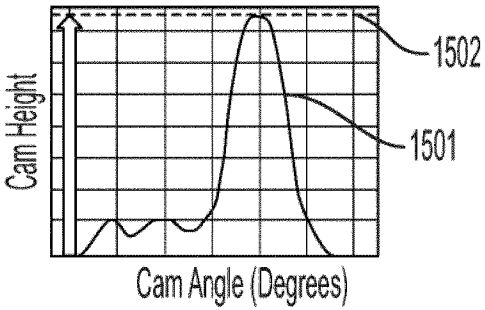
FIG. 15A and FIG. 15B are a chart and a view of a castellation device in cylinder deactivation mode.
Figure 15B:
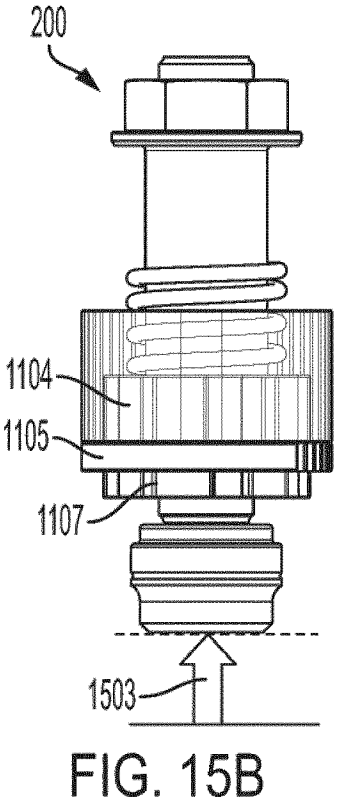

FIG. 15A is a graph and FIG. 15B is an illustration, both showing castellation device 200 in cylinder deactivation mode with guide 1106 hidden. In cylinder deactivation mode, both first spline bushing 1104 and second spline bushing 1105 have been rotated into an unlocked position, and second spline body 1107 is able to intertwine with both first spline bushing 1104 and second spline bushing 1105. In cylinder deactivation mode, using the pictured cam profile 1501, the maximum amount of lift—including all lift transmitted to lost motion shaft 1101 below the magnitude indicated by line 1502—is absorbed by castellation device 200, corresponding to the length indicated by arrow 1503, and no lift is transmitted to a valve so a valve is not opened.

While the above descriptions have, at times, correlated counter-clockwise rotations of the spline bushings with unlocking, and clockwise rotations of the spline bushings with locking, this correlation is not definitive or limiting, and the reverse correlation—counter-clockwise rotations corresponding to locking and clockwise rotations corresponding to unlocking—may be implemented. One spline body may also be configured to lock with clockwise rotations while the other spline body may be configured to lock with counter-clockwise rotations.

Switchable devices enable variable valve actuation (VVA) on rocker arms and other valvetrain components such as valve towers, valve bridges, switching roller finger followers, among others. Switchable devices can be formed as drop-in capsules or can be integrated within bores of the rocker arm or other valvetrain component. It is desired to switch between valve lift profiles such as engine braking (EB), cylinder deactivation (CDA), and variations such as early or late valve opening or closing (EIVC, LIVC, EEVO, LEVO, etc.), or combinations that permit negative valve overlap (NVO) or internal exhaust gas recirculation (iEGR).

To switch among the WVA options, it can be necessary to lock a device for one lift profile and then unlock it for another lift profile. A "lost motion" can be had. A "lost motion" is characterized by some or all of a lift profile being absorbed and not transferred to the valve head. In the context of this application, a "lost motion" can also comprise an amount of lash. A lost motion shaft is included in a castellation assembly. The lost motion shaft is configured to transfer a lift profile to a valve end. It is also configured so that it can slide in lost motion. A portion of the motion by the lost motion shaft is for supplying mechanical lash. Now, the castellation device can achieve both switching as a switchable device and lash adjustment as a mechanical lash adjuster. A separate mechanical lash adjustment capsule is not needed with the switchable castellation device because of the integration at the lost motion shaft.

A lash is a characteristic of an engine. Lash can be supplied using mechanical lash regulation such as the disclosed lost motion shaft. Having one or more lash device at each cylinder (shared to a pair of bridged valves, or one lash device per valve) compensates for the variation of the lashes of the whole valvetrain caused by thermal elongation and wear. A user can set a lash height forming a controlled gap. Heat up in the system shortens the gap. The gap can be chosen so that each valve or pair of bridged valves have a different lash setting but same gap. Now, during heat up, the expansion of parts can fill the gap but not cause a critical shift of the valve head. Or, as the parts wear, the gap increases for all valves but a servicer can adjust the lash and reset the gap. So, at installation or service, the lash regulation screw can be set or replaced relative to the lost motion shaft to set the lash. A threaded coupling can be used or a press or crush fit or the like. Using a capsule or drop-in strategy allows the switchable castellation device to be removed and a new one to be installed without removing or replacing the whole cylinder head.

In a first example, a switchable castellation device comprises two positions: "locked" (low or short lost motion and lash) and "unlocked" (long lost motion). In both positions, the lost motion shaft slides in the castellation device and a portion of the sliding motion is considered "lost motion" because the sliding prevents force from being transferred through the rocker arm to the valve. A rotating cam or other valve actuator that normally acts to transfer a valve lift to a valve can continue to transfer force at it preset cadence, but the force is absorbed in lost motion. The lost motion is desired because it can also constitute the desired lash with the sliding of the lost motion shaft corresponding to the closing of the controlled gap.

Current lost motion devices only permit a few millimeters of lost motion, but the disclosed switchable castellation device permits more lost motion because the whole spline body can be designed to slide into the spline bushing, creating a long lost motion stroke for the lost motion shaft. The long lost motion stroke enables the absorbing of longer strokes, too, such as late intake valve closing (LIVC) or early exhaust valve opening (EEVO). Cylinder deactivation (CDA) can be combined with these longer variable valve actuation techniques.

A spline bushing can be integrated inside a rocker arm with a rack and pinion or other actuation arrangement to rotate the spline bushing. A piston can be controlled hydraulically, pneumatically, or electromagnetically to move between two positions. The piston can comprise a toothed rack while the spline bushing comprises outer grooves or teeth forming a pinion against which the toothed rack moves to spin the spline bushing. The locked position and the unlocked position can be switched between by moving the toothed rack.

Inside of the spline bushing, another set or grooves and teeth can form an outer spline body around the lost motion shaft. A guide can also be around the lost motion shaft. Guide can be used as an anti-rotation device and can also be used as a guide for the spline body. Spline body can comprise complementary grooves and teeth forming an inner spline body. Inner spline body teeth are configured to align, in the locked position, face-to-face with the teeth of the outer spline body. In the unlocked position, the teeth of the inner spline body are configured to slide in the grooves of the outer spline body. Spline body can slide up into the spline bushing and the lost motion shaft can travel upwards in lost motion and with a long stroke. No valve actuation force is transferred to the valve or valves unless a travel limit is reached and a force is applied through the rocker arm or other valvetrain component. Travel limits can be formed via steps or rims within the bore or capsule in which the switchable castellation device is mounted. Additionally or alternatively, rims or steps can be formed on the lost motion shaft, the spline bushing, or spline body.

A lost motion spring can be included to bias the lost motion shaft to a fully extended position. The lost motion spring can collapse during lost motion and can absorb the valve lift profile without causing the valve to open (at all or until the travel limit is reached).

In a second embodiment, a three stage switchable castellation device can be configured to provide engine braking and cylinder deactivation, with the long stroke benefits outlined above.

A standard mode (short lost motion), engine braking (no lost motion), and cylinder deactivation (long lost motion) can be achieved. These can be combined with the benefits of mechanical lash conveyed.

A second spline bushing is added to control the engine braking lost motion stroke. The second spline bushing can be configured similarly to the first spline bushing (above) and a second rack can be added to control the second spline bushing. A "double rack" actuation assembly can be included to control the switchable castellation device.

Other implementations will be apparent to those skilled in the art from consideration of the specification and practice of the examples disclosed herein.

What is claimed is:

1. A switchable castellation assembly, comprising:

a lost motion shaft, the lost motion shaft being configured to transfer a lift profile to a valve end; and a switchable castellation device, the switchable castellation device comprising:

a first spline bushing having a plurality of spline grooves extending axially along an inner circumference thereof; and a spline body having a plurality of spline grooves extending axially along an outer circumference thereof;

wherein the first spline bushing is configured to switch between a locked position and an unlocked position, and wherein a lost motion is obtained by sliding the lost motion shaft when the first spline bushing is in the unlocked position.

2. The switchable castellation assembly of claim 1, further comprising a second spline bushing, wherein the second spline bushing is configured to switch between a second locked position and a second unlocked position.

3. The switchable castellation assembly of claim 2, further comprising a guide, wherein the guide aligns the spline body with the first spline bushing and the second spline bushing.

4. The switchable castellation assembly of claim 2, further comprising an actuator for rotating the second spline bushing between the second locked position and the second unlocked position.

5. The switchable castellation assembly of claim 1, further comprising a guide, wherein the guide aligns the spline body with the first spline bushing.

6. The switchable castellation assembly of claim 1, further comprising a lash regulation screw for setting a lash for the lost motion shaft.

7. The switchable castellation assembly of claim 1, further comprising a lost motion spring, wherein the lost motion spring is configured to bias the lost motion shaft to a fully extended position, and wherein the lost motion spring is configured to collapse during the lost motion.

8. The switchable castellation assembly of claim 1, further comprising a first actuator for rotating the first spline bushing between the locked position and the unlocked position.

9. A switchable castellation assembly comprising:

a lost motion shaft comprising an axis with a top end and a bottom end;

a lash regulation screw arranged at the top end of the lost motion shaft;

a lost motion spring arranged along an axial length of the lost motion shaft;

a first spline bushing having a plurality of spline grooves extending axially along an inner circumference thereof;

a guide arranged along the axial length of the lost motion shaft; and a spline body having a plurality of spline grooves extending axially along an outer circumference thereof;

wherein the first spline bushing is positioned to selectively receive or block the spline body, wherein the guide orients the spline body with respect to the first spline bushing, wherein, when the first spline bushing is in a first position to receive the spline body, motion exerted on the switchable castellation assembly is absorbed by the switchable castellation assembly, and wherein, when the first spline bushing is in a second position to block the spline body, motion exerted on the switchable castellation assembly is not absorbed by the switchable castellation assembly.

10. The switchable castellation assembly of claim 9, wherein the first spline bushing comprises:

a first bushing bore forming an outer circumference of the first spline bushing and the inner circumference of the first spline bushing;

a first actuator interface arranged on, at least some portion of, the outer circumference of the first spline bushing; and a first spline interface defined by the plurality of spline grooves arranged on, at least some portion of, the inner circumference of the first spline bushing, wherein the first spline interface further comprises a first spline index.

11. The switchable castellation assembly of claim 9, wherein the guide comprises:

a guide bore forming an outer circumference of the guide and an inner circumference of the guide;

a guide notch arranged on, at least some portion of, the outer circumference of the guide; and a guide interface arranged on, at least some portion of, the inner circumference of the guide, wherein the guide interface further comprises a guide index.

12. The switchable castellation assembly of claim 9, wherein the spline body comprises:

a spline body bore forming an outer circumference of the spline body and an inner circumference of the spline body; and a spline body interface defined by the plurality of spline grooves arranged on, at least some portion of, the outer circumference of the spline body, wherein the spline body interface further comprises a spline body index.

13. The switchable castellation assembly of claim 9, wherein the first spline bushing comprises:

a first bushing bore forming an outer circumference of the first spline bushing and the inner circumference of the first spline bushing;

a first actuator interface arranged on, at least some portion of, the outer circumference of the first spline bushing; and a first spline interface defined by the plurality of spline grooves arranged on, at least some portion of, the inner circumference of the first spline bushing, wherein the first spline interface further comprises a first spline index, wherein the guide comprises:

a guide bore forming an outer circumference of the guide and an inner circumference of the guide;

a guide notch arranged on, at least some portion of, the outer circumference of the guide; and a guide interface arranged on, at least some portion of, the inner circumference of the guide, wherein the guide interface further comprises a guide index, wherein the spline body comprises:

a spline body bore forming the outer circumference of the spline body and an inner circumference of the spline body; and a spline body interface defined by the plurality of spline grooves arranged on, at least some portion of, the outer circumference of the spline body, wherein the spline body interface further comprises a spline body index, wherein the guide interface is formed by a plurality of guide grooves arranged along the axial length of the guide.

14. The switchable castellation assembly of claim 13, wherein the guide grooves are configured to orient the spline grooves on the spline body, and wherein the spline grooves on the first spline bushing are configured to receive the spline grooves of the spline body in the first position or to block the spline grooves of the spline body in the second position.

15. A method of operating a switchable castellation device comprising:

rotating a first spline bushing into an unlocked position;

sliding a spline body into the first spline bushing such that the first spline bushing intertwines with the spline body; and sliding the spline body away from the first spline bushing such that the first spline bushing is no longer intertwined with the spline body, wherein the switchable castellation device includes:

a first spline bushing having a plurality of spline grooves extending axially along an inner circumference thereof; and a spline body having a plurality of spline grooves extending axially along an outer circumference thereof.

16. The method of operating a switchable castellation device of claim 15, further comprising: rotating the first spline bushing from an unlocked position into a locked position; and sliding the spline body into the first spline bushing such that the spline body abuts the first spline bushing but does not intertwine.

17. The method of operating a switchable castellation device of claim 15, further comprising:

rotating a second spline bushing into an unlocked position; and sliding a spline body into the first spline bushing and the second spline bushing such that the spline body slidably interacts with at least a portion of the first spline bushing and at least a portion of the second spline bushing.

18. The method of operating a switchable castellation assembly of claim 15, further comprising:

rotating a second spline bushing into a locked position; and sliding the spline body into the second spline bushing such that the spline body abuts the second spline bushing but does not slide within any portion of the second spline bushing.

* * * * *